US009630050B2

(12) United States Patent
Wu

(10) Patent No.: US 9,630,050 B2
(45) Date of Patent: Apr. 25, 2017

(54) OFFICE WALKING EQUIPMENT

(71) Applicant: STRENGTH MASTER FITNESS TECH CO., LTD., Changhua County (TW)

(72) Inventor: Shu Yao Wu, Taichung (TW)

(73) Assignee: Strength Master Fitness Tech Co., Ltd., Changhua County (TW)

( * ) Notice: Subject to any disclaimer, the term of this patent is extended or adjusted under 35 U.S.C. 154(b) by 0 days.

(21) Appl. No.: 14/960,582

(22) Filed: Dec. 7, 2015

(65) Prior Publication Data

US 2016/0082309 A1 Mar. 24, 2016

Related U.S. Application Data

(63) Continuation-in-part of application No. 14/672,415, filed on Mar. 30, 2015, now abandoned, which is a continuation-in-part of application No. 13/606,192, filed on Sep. 7, 2012, now abandoned.

(51) Int. Cl.

| | |
|---|---|
| ***A63B 22/02*** | (2006.01) |
| ***A47B 17/00*** | (2006.01) |
| ***A47B 97/00*** | (2006.01) |

(52) U.S. Cl.

CPC ..... *A63B 22/02* (2013.01); *A47B 17/00* (2013.01); *A47B 97/00* (2013.01); *A63B 22/0207* (2015.10); *A47B 2200/0066* (2013.01); *A47B 2220/06* (2013.01); *A63B 2210/00* (2013.01); *A63B 2210/50* (2013.01); *A63B 2225/09* (2013.01); *A63B 2225/68* (2013.01)

(58) Field of Classification Search

CPC . A63B 22/02; A63B 22/0207; A63B 2210/00; A63B 2210/50; A63B 2225/09; A63B 2225/68; A47B 97/00; A47B 17/00; A47B 2200/0066; A47B 2200/06; A47B 2097/008; Y10T 403/32557; Y10T 403/32581

See application file for complete search history.

(56) References Cited

U.S. PATENT DOCUMENTS

| | | | | |
|---|---|---|---|---|
| 6,234,937 | B1 * | 5/2001 | Yu | A63B 22/02 482/54 |
| 7,892,148 | B1 * | 2/2011 | Stauffer | A63B 22/0235 482/51 |
| 9,511,254 | B2 * | 12/2016 | Netter | A63B 22/0235 |
| 2008/0234111 | A1 * | 9/2008 | Packham | A63B 22/02 482/54 |
| 2013/0150214 | A1 * | 6/2013 | Wu | A63B 71/0622 482/4 |

(Continued)

*Primary Examiner* — Loan H Thanh
*Assistant Examiner* — Megan Anderson
(74) *Attorney, Agent, or Firm* — Rosenberg, Klein & Lee

(57) ABSTRACT

An office walking equipment includes a platform and a working table. The platform is disposed on the ground and provided for a user to exercise. The working table is principally provided for work. When the platform is in use, a front end of the platform is relatively below the working table. When the platform is not in use, the platform can be separated from the working table. The platform is assembled with the working table in a non-contact manner, so that when the user performs exercise on the platform, the vibration of the platform caused by the exercise is not transmitted to the working table to affect the user's working performance.

8 Claims, 14 Drawing Sheets

(56) References Cited

U.S. PATENT DOCUMENTS

| | | | | |
|---|---|---|---|---|
| 2013/0237381 | A1* | 9/2013 | Chen | A63B 22/02 482/54 |
| 2013/0237383 | A1* | 9/2013 | Chen | A63B 22/02 482/54 |

* cited by examiner

OFFICE WALKING EQUIPMENT

REFERENCE TO RELATED APPLICATIONS

This application is being filed as a Continuation-in-Part of application Ser. No. 14/672,415, filed 30 Mar. 2015, which was a Continuation-in-Part of application Ser. No. 13/606,192, filed 7 Sep. 2012, now abandoned.

BACKGROUND OF THE INVENTION

Field of the Invention

The present invention generally relates to a fitness device, in particular to an office walking equipment capable of providing work and exercise.

Description of the Related Art

As shown in FIG. 13, a conventional exercise device capable of providing works and exercises is disclosed in U.S. Pat. No. 7,892,148. The device includes a treadmill 91 and a working table 92. The working table 92 is disposed at a front end of a treadmill 91, and a computer having a monitor 93, a mouse 94, and a keyboard 95 is disposed on the working table 92. When a user utilizes the treadmill 91 to perform exercise, the computer can be operated on the working table 92 at the same time to achieve the effect of simultaneous working and exercise.

However, as shown in FIG. 14, since the treadmill 91 is assembled with the working table 92 by the engagement between a protruded body 911 of the treadmill 91 and an engaging recess 97 of a bar 96 at the bottom of the working table 92, when a user utilizes the treadmill 91 to perform exercise, the vibration generated by the treadmill 91 would be directly transmitted to the working table 92, adversely affecting the user's working performance.

Another conventional exercise device having a working table and a treadmill is disclosed in US patent application 2008/0234111. In the exercise device, the working table is assembled with the treadmill by the contact between wheels of the treadmill and rails of the working table. However, since the wheels are directly in contact with the rails, when a user utilizes the treadmill to perform exercise, the vibration generated by the treadmill would be directly transmitted to the working table, causing the same problem.

SUMMARY OF THE INVENTION

Therefore, an objective of the present invention is to provide an office walking equipment in which the vibration generated by the treadmill can be prevented from being transmitted to the working table.

Another objective of the present invention is to provide an office walking equipment in which the working table can be prevented from being toppled over.

To achieve the foregoing objectives, the present invention provides an office walking equipment. The office walking equipment comprises a platform, a working table, and a limiting device. The platform is disposed on the ground and capable of allowing a user to perform walking exercise. The working table is principally provided for work. The platform has a front end. When the platform is in use, the front end is relatively positioned below the working table, so that the platform is at a first position that allows the user to perform walking exercise thereon. When the platform is separated from the working table, the platform is at a second position. The platform has a supporting structure provided for resting the platform on the ground. The limiting device has a first baffle member disposed on the platform and a second baffle member disposed on the working table. When the platform is at the first position, the position of the first baffle member corresponds to the position of the second baffle member, and a gap is defined between the first baffle member and the second baffle member, so that the first baffle member is not in contact with the second baffle member, and a force applied to the platform is not transmitted to the working table to prevent the working table from being shaken. When the working table is moved with respect to the platform, the first baffle member restricts a displacement of the second baffle member so as to prevent the working table from being toppled over.

Preferably, the first baffle member is disposed across above the second baffle member. When the platform is lifted to a predetermined height, the first baffle member is no more across the second baffle member, and the platform is separable with respect to the working table.

Preferably, the first baffle member and the second baffle member of the limiting device are respectively extended and protruded from side portions of the platform and side portions of the working table.

Preferably, one side of the first baffle member near to the second baffle member has a baffle section in upward arc shape, the second baffle member has a protruded bar. When the platform is at the first position, the protruded bar of the second baffle member is restricted within the baffle section of the first baffle member.

Preferably, one side of the second baffle member near to the first baffle member has a baffle section in downward arc shape, the first baffle member has a protruded bar. When the platform is at the first position, the protruded bar of the first baffle member is restricted within the baffle section of the second baffle member.

Moreover, the supporting structure comprises a base, and pivot portions are respectively assembled to the platform and the base, such that after the platform is separated from the working table, the platform is pivotable with respect to the base so as to be stood on the ground. In addition, a fastening element is disposed between the base and the platform to hold the platform standing on the ground.

Moreover, the supporting structure is disposed at the front end of the platform, and the supporting structure defines a supporting plane at the front end of the platform to abut against the ground.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

Figure 1:
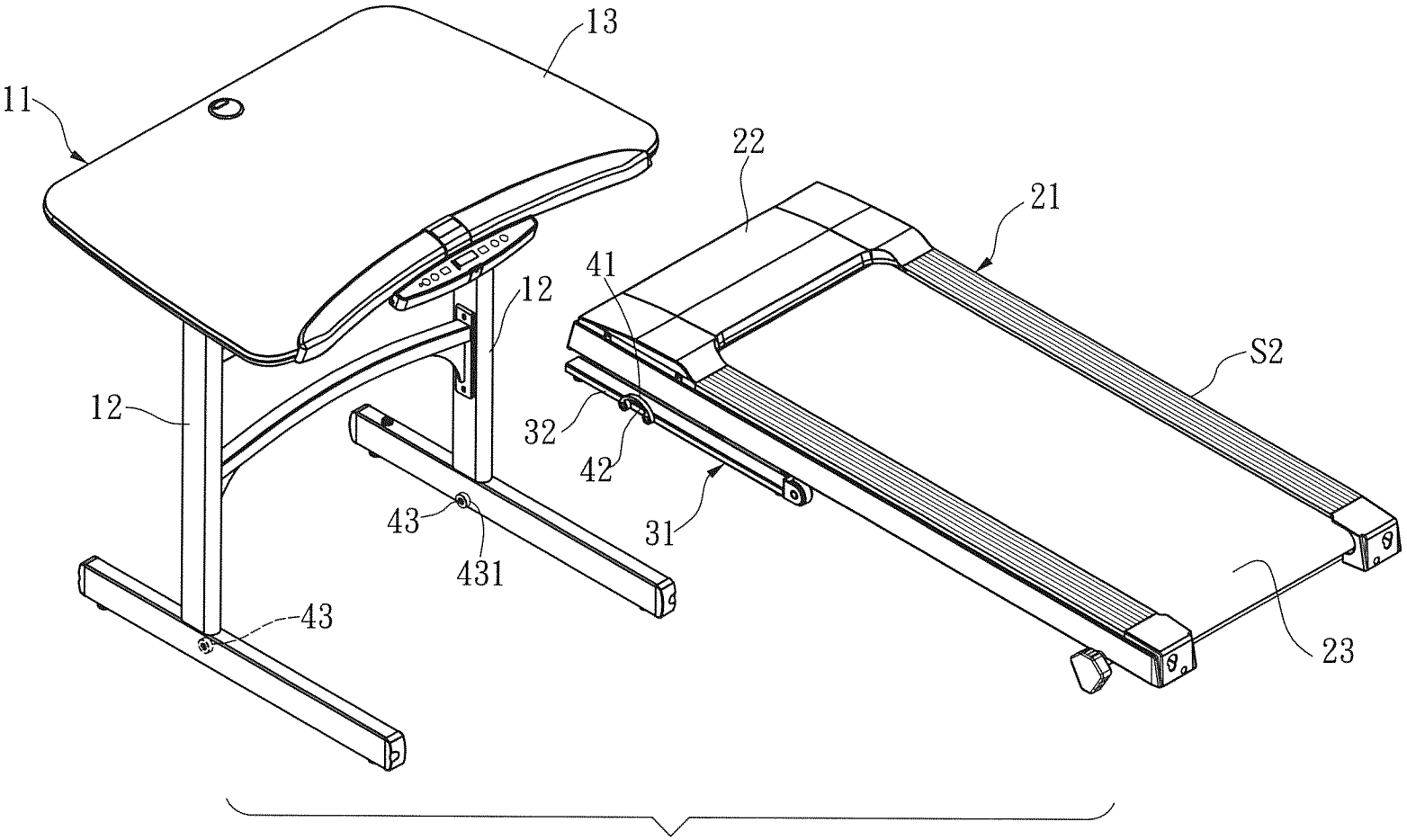
FIG. 1 illustrates an exploded view of a first embodiment of the present invention.
Figure 2:
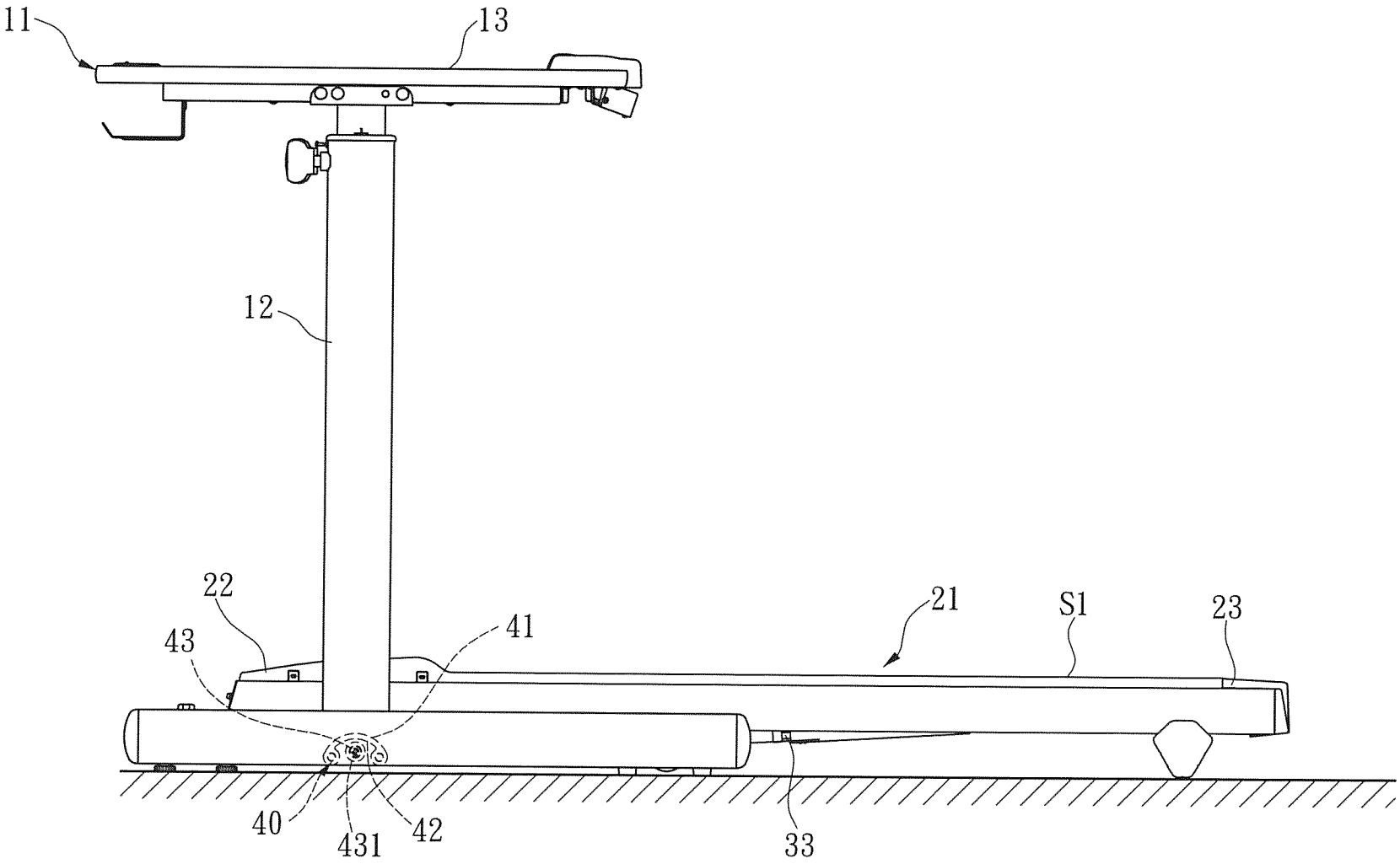
FIG. 2 illustrates a structural schematic view of the first embodiment of the present invention.

The technical content of the present invention will become apparent by the detailed description of the following embodiments and the illustration of related drawings as follows.

Please refer to FIGS. 1 to 7; an office walking equipment according to a first embodiment of the present invention is illustrated. The office walking equipment mainly comprises a platform 21, a working table 11, and a limiting device 40. The platform 21 is disposed on the ground and capable of allowing a user to perform walking exercise thereon. The working table 11 is across above the platform 21.

The working table 11 is downwardly extended with two support racks 12 spaced at an interval and abutted against the ground, and a table surface 13 capable of principally providing work is disposed on tops of the two support racks 12.

Figure 7:
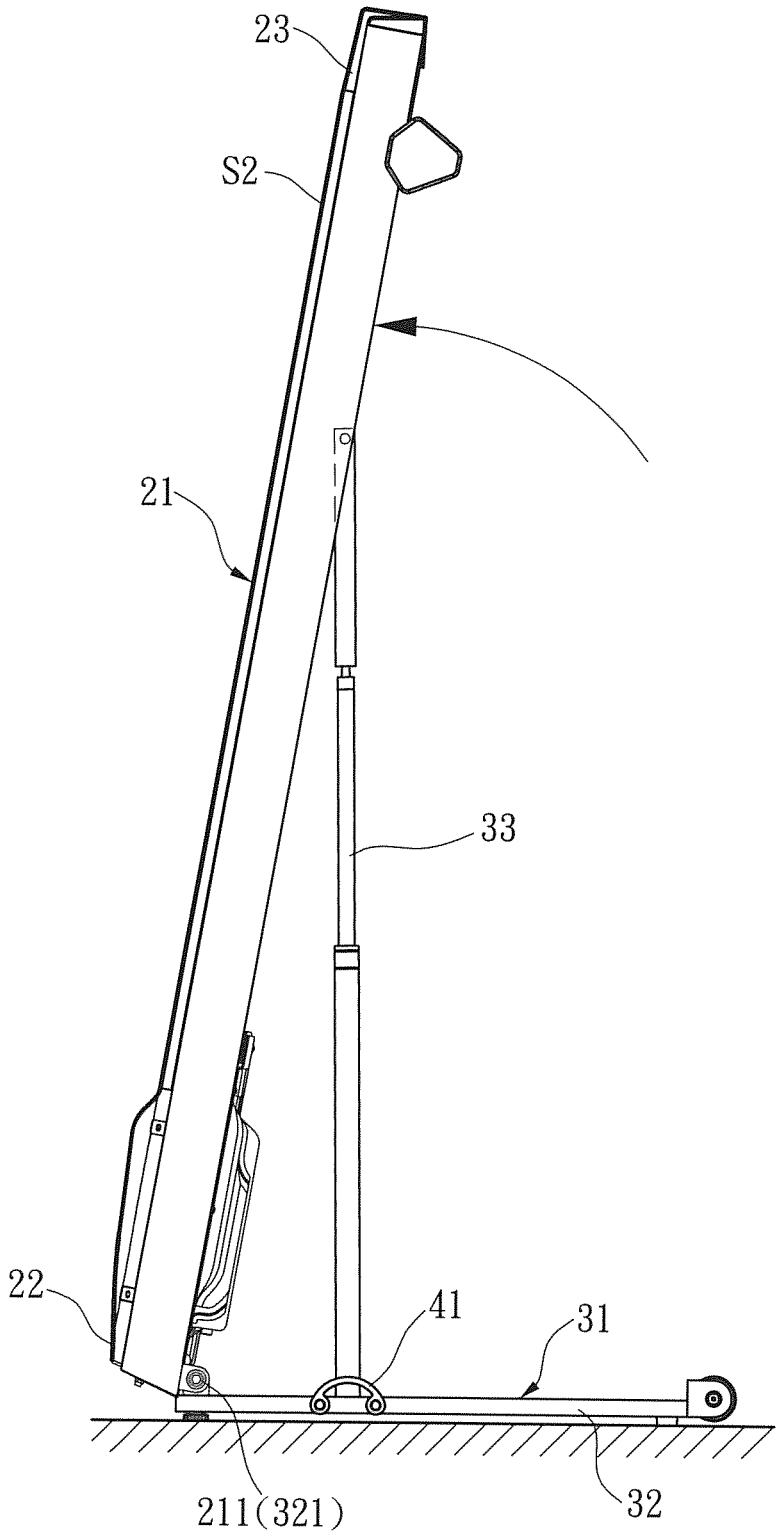
FIG. 7 illustrates an operational schematic view showing the platform is standing on the ground via the supporting structure after the platform is separated from the working table according to the first embodiment of the present invention.

The platform 21 has a front end 22 and a rear end 23. When the platform 21 is in use, the front end 22 is relatively below the working table 11, and the two support racks 12 are relatively located at two sides of the front end 22 of the platform 21, such that the platform 21 is placed at a first position S1 capable of allowing the user to perform walking exercise thereon. A bottom of the front end 22 of the platform 21 has a supporting structure 31 provided for standing the platform 21 on the ground. The supporting structure 31 comprises a base 32. Pivot portions 211, 321 are respectively assembled to the front end 22 of the platform 21 and the base 32 (as shown in FIG. 7), such that the base 32 is pivoted to the bottom of the front end 22 of the platform 21. A fastening element 33 is disposed between the base 32 and the platform 21 to hold the platform 21 standing on the ground. In this embodiment, the fastening element 33 is a telescopic rod structure.

The position limiting device 40 comprises a first baffle member 41 and a second baffle member 43. The first baffle member 41 is disposed on the platform 21, the second baffle member 43 is disposed on the working table 11, and the position of the first baffle member 41 corresponds to the position of the second baffle member 43 when the platform 21 is at the first position S1. In this embodiment, two first baffle members 41 are respectively extended and protruded from the base 32 toward two sides of the two support racks 12. One side of each of the first baffle members 41 has a baffle section 42 in upward arc shape, and when the platform 21 is at the first position S1, the side of each of the first baffle members 41 having the baffle section 42 is near to the corresponding second baffle member 43. Two second baffle members 43 are respectively extended and protruded from the two support racks 12 toward one side of the base 32. Each of the second baffle members 43 has a protruded bar 431. When the front end 22 of the platform 21 is relatively located below the working table 11 and at the first position S1, the first baffle members 41 correspond to the second baffle members 43 and a gap D is defined between each of the first baffle members 41 and the corresponding second baffle member 43, so that the first baffle members 41 are not in contact with the second baffle members 43, respectively. Therefore, each of the first baffle members 41 are across above the protruded bar 431 of the corresponding second baffle member 43, and the protruded bars 431 of the two second baffle members 43 are respectively restricted within the baffle sections 42 of the two first baffle members 41, so that the protruded bar 431 of each of the second baffle members 43 is surrounded by the baffle section 42 of the corresponding first baffle member 41.

Figure 5:
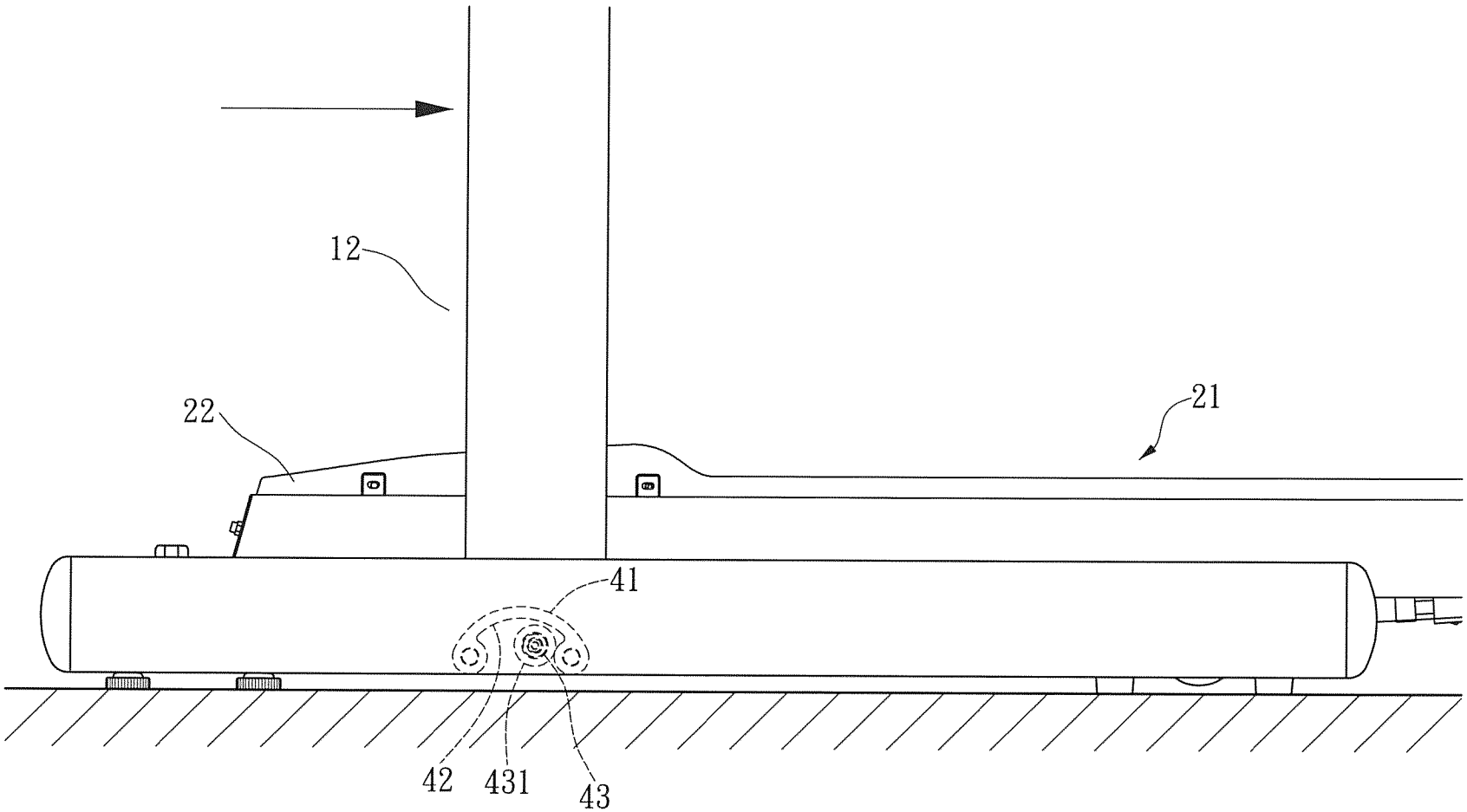
FIG. 5 illustrates an operational schematic view showing the working table is moved laterally with respect to the platform according to the first embodiment of the present invention.
Figure 6:
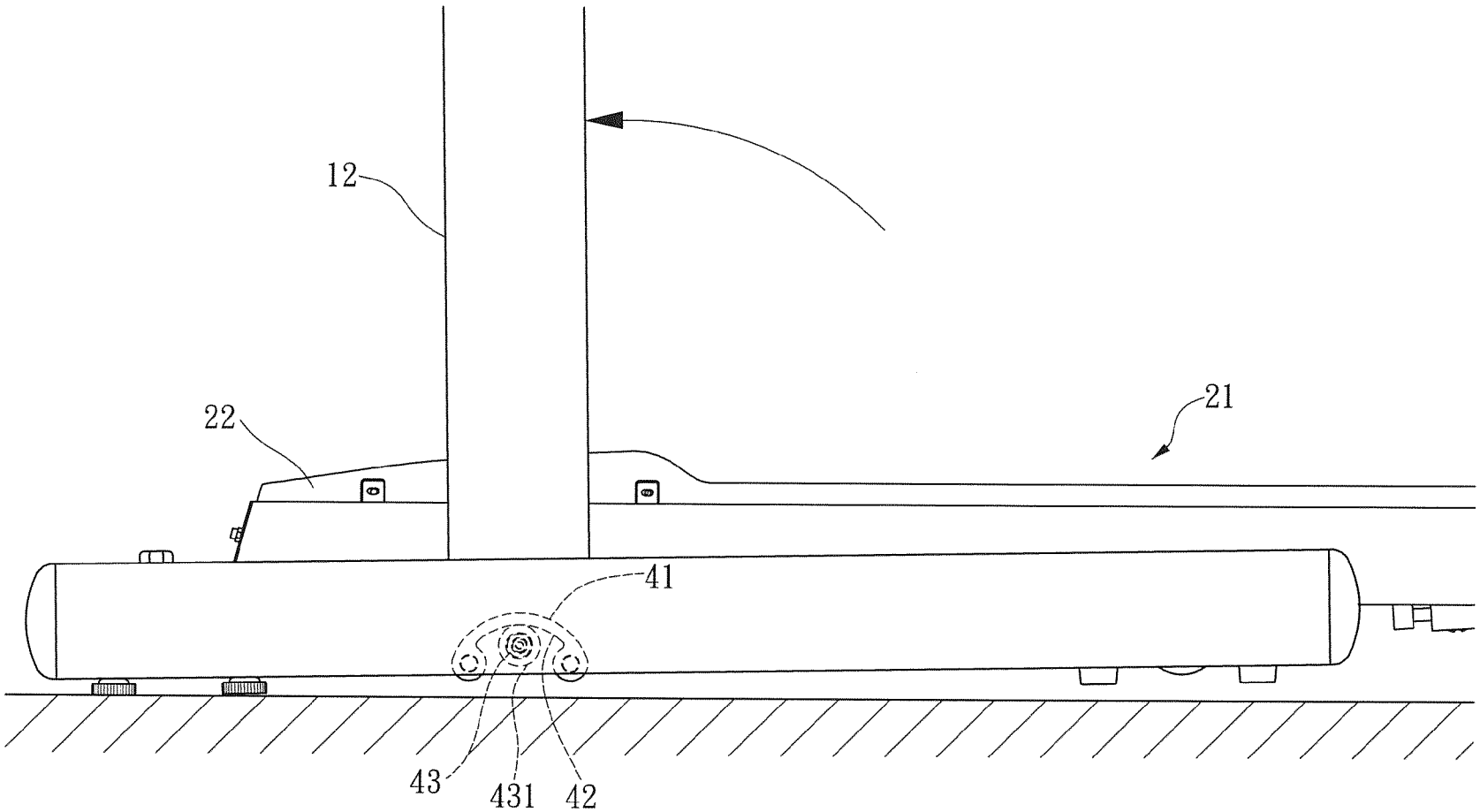
FIG. 6 illustrates an operational schematic view showing the working table is moved upward with respect to the platform according to the first embodiment of the present invention.

Moreover, when the front end 22 of the platform 21 is relatively located below the working table 11, the baffle section 42 of each of first baffle members 41 is across above the protruded bar 431 of the corresponding second baffle member 43, and the protruded bars 431 of the two second baffle members 43 are respectively protruded in the baffle sections 42 of the first baffle members 41. Therefore, upon an external force is applied to the working table 11 to move the working table 11 upwardly or laterally with respect to the platform 21, as shown in FIG. 5 and FIG. 6, the protruded bars 431 of the second baffle members 43 disposed at the two support racks 12 are respectively baffled by the baffle sections 42 of the first baffle members 41 on the platform 21 to further limit the displacement of the working table 11 and prevent the working table 11 from being toppled over due to over movement of the working table 11. Accordingly, user safety can be ensured during operating the equipment.

When the platform 21 is not in use, the user can simply lifts the front end 22 or the rear end 23 of the platform 21 to a predetermined height, so that the first baffle members 41 are no more across the second baffle members 43, and the platform 21 can be separated from the working table 11 to be at a second position S2.

Next, after the platform 21 is separated from the working table 11 and at the second position S2, as shown in FIG. 7, the user can deflect the platform 21 upwardly to allow the platform 21 pivoting relative the base 32, so that the platform 21 can be stood on the ground alone by the fastening element 33 between the base 32 and the platform 21. Accordingly, the space for saving the platform 21 can be effectively reduced, thereby easing the storage of the platform 21.

Figure 3:
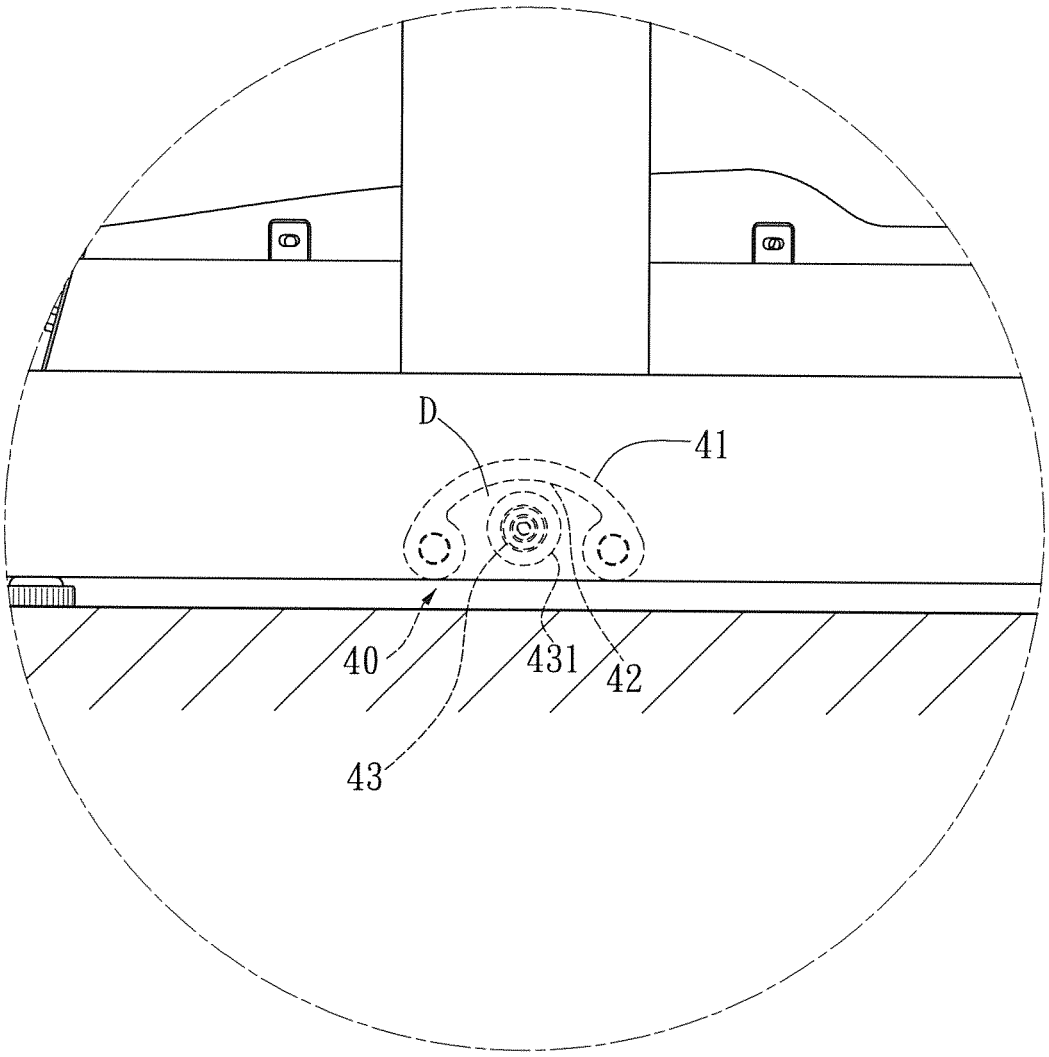
FIG. 3 illustrates a partial enlarged view of the first embodiment of the present invention.
Figure 4:
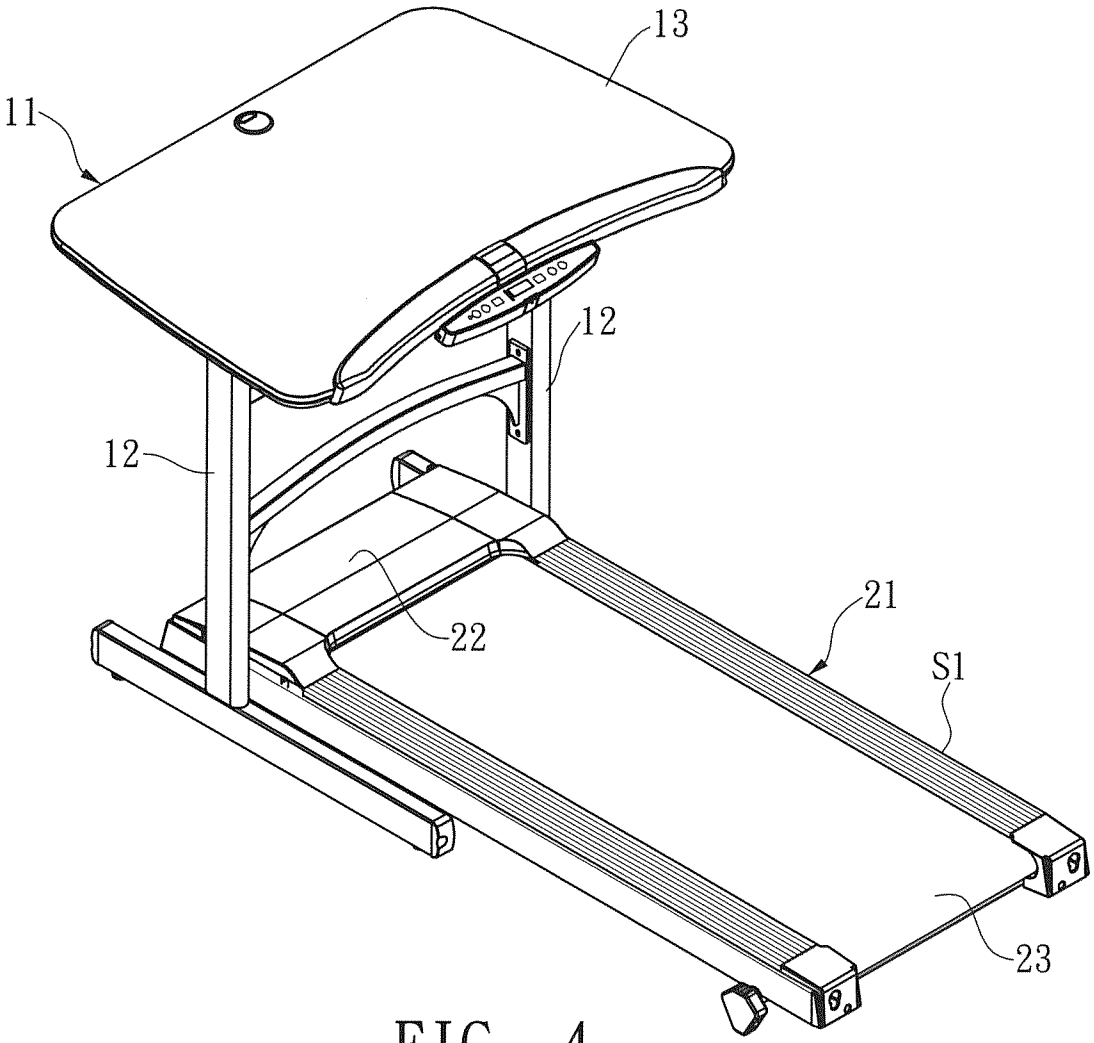
FIG. 4 illustrates a perspective view showing a front end of the platform is disposed relatively below the working table according to the first embodiment of the present invention.

Moreover, as shown in FIG. 3, when the platform 21 is at the first position S1, the first baffle member 41 is not in contact with the second baffle member 43. Therefore, when the user performs walking exercise on the platform 21, the vibration generated by the platform 21 is not directly transmitted to the working table 11 to affect the user's working. The first baffle member 41 may be in contact with the second baffle member 43 when the platform 21 is at the first position S1 in cases shown by FIG. 5 and FIG. 6. As shown in FIG. 5 and FIG. 6, the second baffle member 43 is in contact with the first baffle member 41 when the working table 11 is forced to be moved laterally or upwardly with respect to the platform 21. In such conditions, the user would realize the position of the working table 11 with respect to the platform 21 should be adjusted to allow the first baffle member 41 not in contact with the second baffle member 43 and prevent the vibration generated by the platform 21 from being transmitted to the working table 11. Accordingly, the first baffle member 41 can be provided for limiting the second baffle member 43 from over movement, preventing the working table 11 from being separated from the platform 21, and preventing the vibration generated by the platform 21 from being transmitted to the working table 11 directly.

Figure 8:
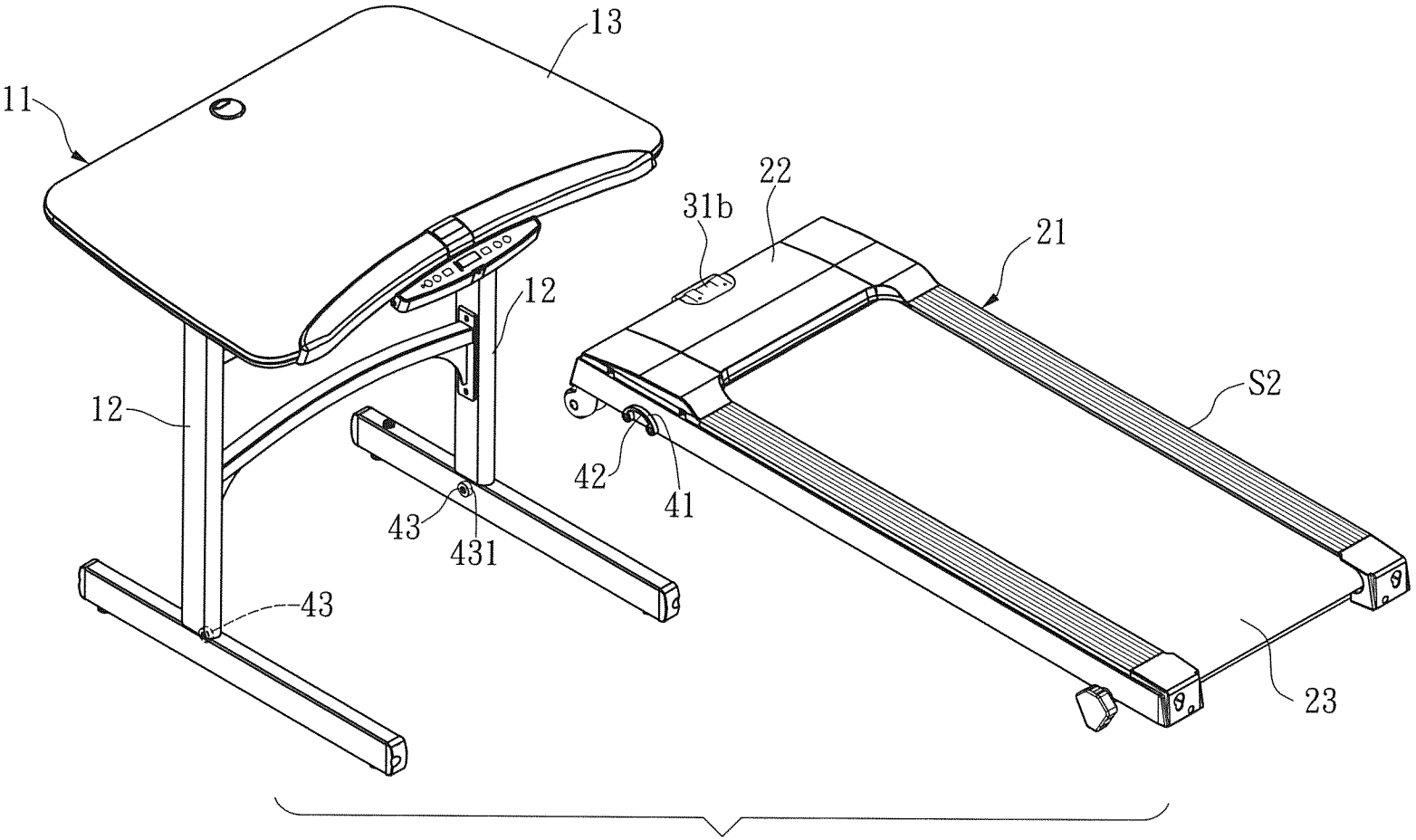
FIG. 8 illustrates an exploded view of a second embodiment of the present invention.
Figure 9:
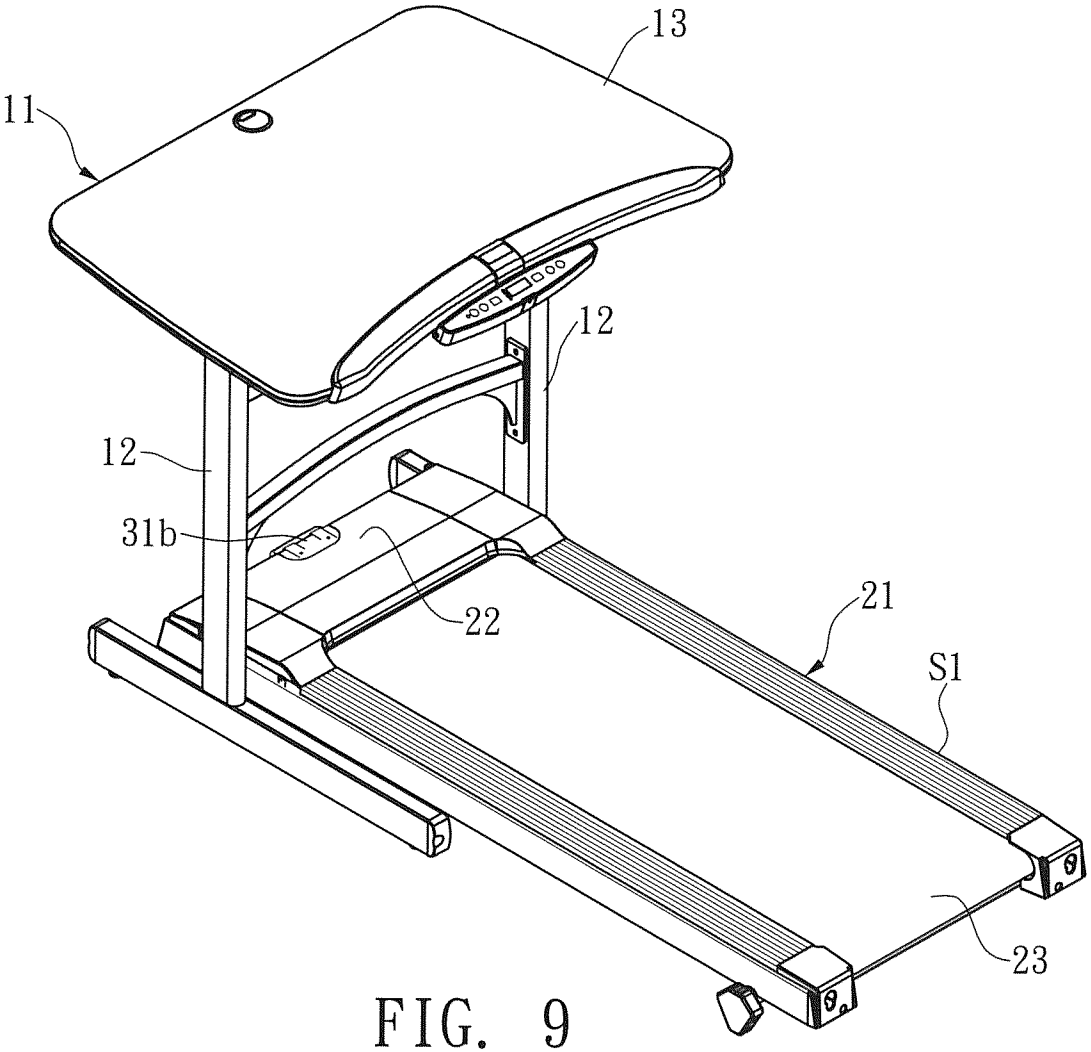
FIG. 9 illustrates a perspective view showing a front end of the platform is relatively below the working table according to the second embodiment of the present invention.
Figure 10:
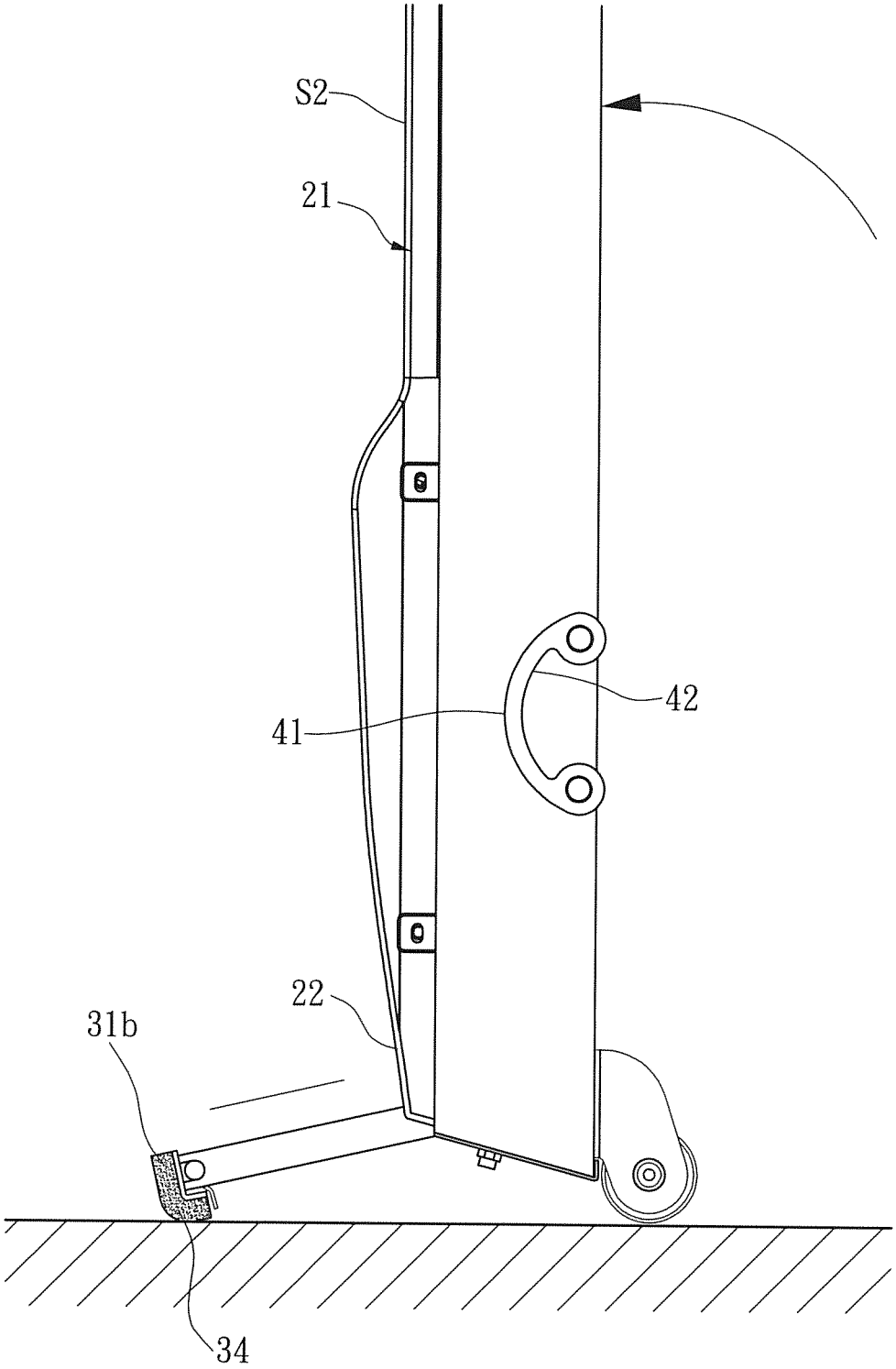
FIG. 10 illustrates an operational schematic view showing the platform is standing on the ground via the supporting structure after the platform is separated from the working table according to the second embodiment of the present invention.

Please refer to FIGS. 8 to 10; an office walking equipment according to a second embodiment of the present invention is illustrated. The structure of the second embodiment is approximately the same as that of the first embodiment, except that in the second embodiment, a supporting structure 31*b* is disposed at the front end 22 of the platform 21 for standing the platform 21 on the ground, and the supporting structure 31*b* defines a supporting plane 34 at the front end 22 of the platform 21 to abut against the ground. In this embodiment, the supporting structure 31*b* may be implemented by a supporting member capable of being extended forwardly along a longitudinal direction from the front end 22 of the platform 21, and after the supporting member is extended forward along the longitudinal direction from the front end 22 of the platform 21, the supporting member defines the supporting plane 34 at the front end 22 of the platform 21 to abut against the ground.

When the platform 21 is not in use, the user can simply lifts the front end 22 or the rear end 23 of the platform 21 to a predetermined height, so that the first baffle members 41 are no more across the second baffle members 43, and the platform 21 can be separated from the working table 11. Next, when the platform 21 is separated from the working table 11 to be at the second position S2, as shown in FIG. 10, the user can deflect the platform 21 upwardly so that the supporting plane 34 defined by the extended supporting member is abutted against the ground for standing the platform 21 alone on the ground. Therefore, the space for saving the platform 21 can be effectively reduced, thereby easing the storage of the platform 21.

Figure 11:
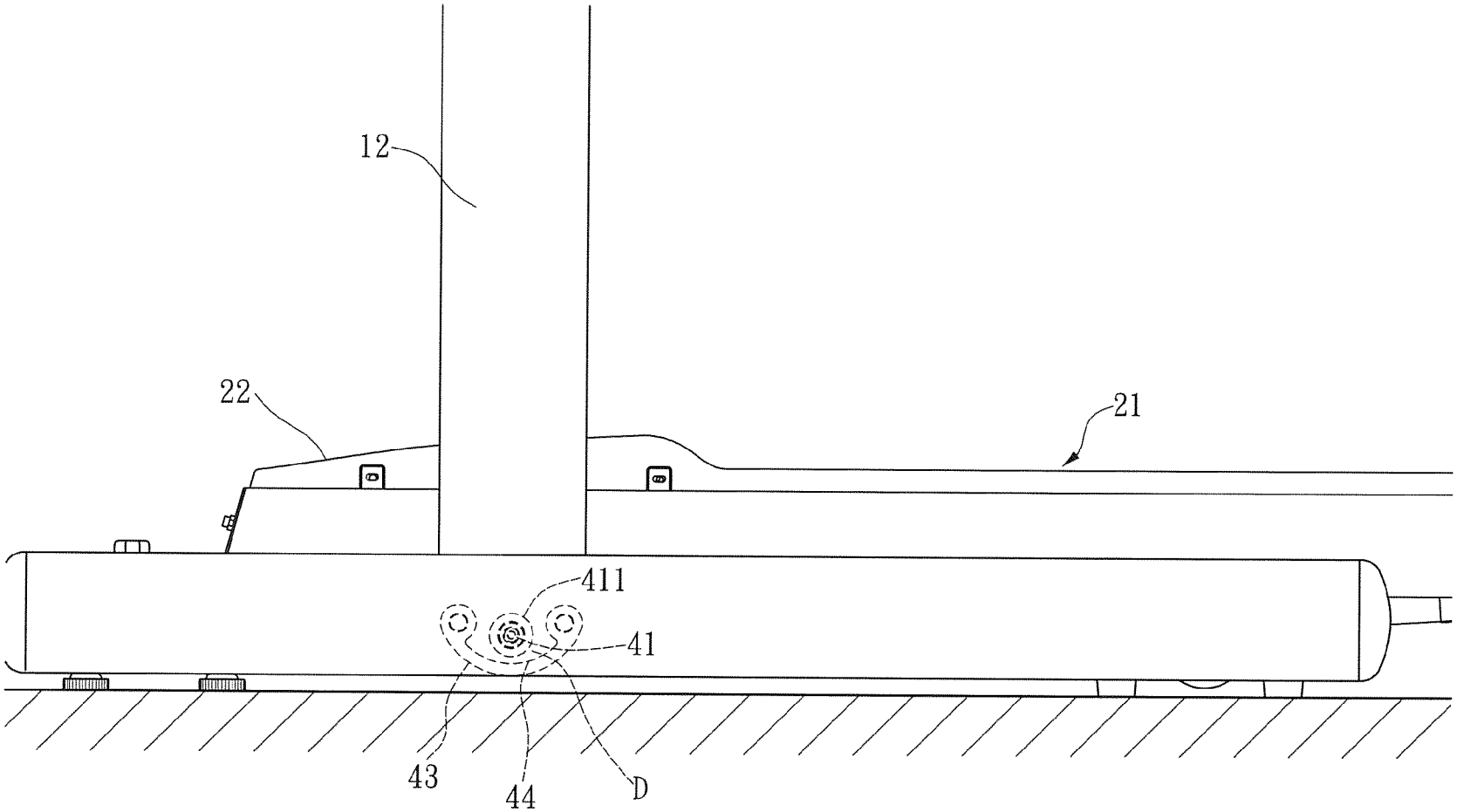
FIG. 11 illustrates a structural schematic view of a third embodiment of the present invention.
Figure 12:
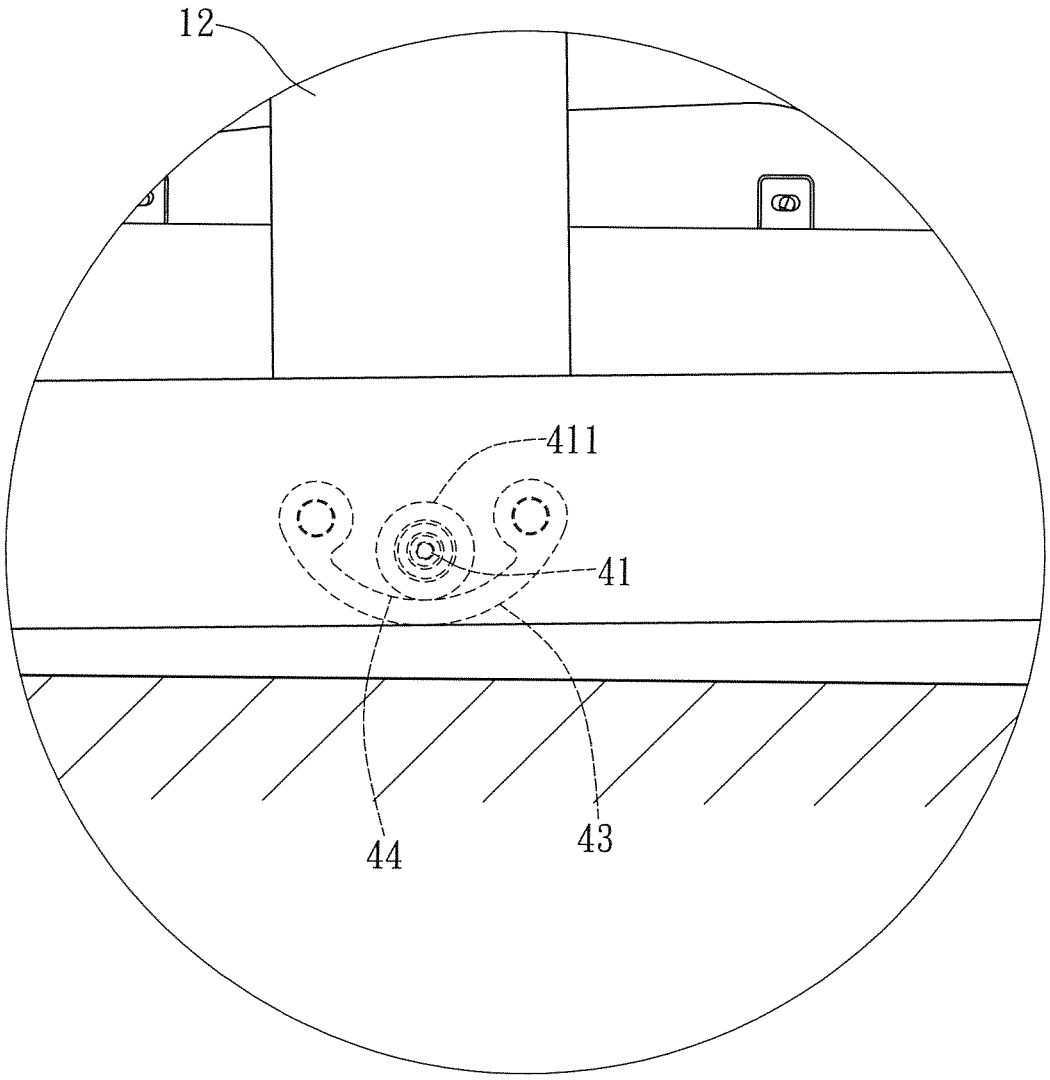
FIG. 12 illustrates an operational schematic view showing the working table is moved upward with respect to the platform according to the third embodiment of the present invention.
Figure 13:
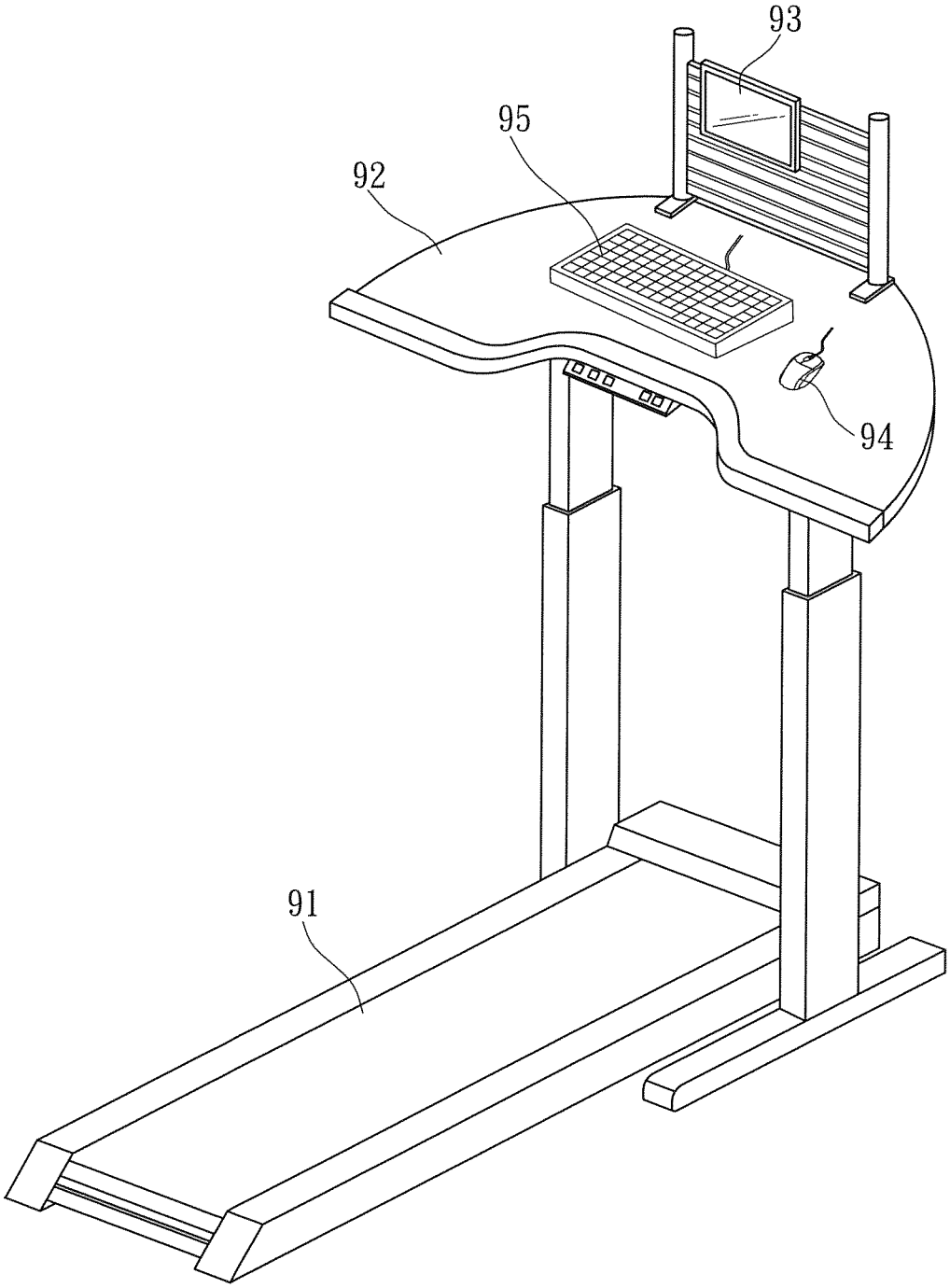
FIG. 13 PRIOR ART
FIG. 13 illustrates a perspective view of an exercise device disclosed in U.S. Pat. No. 7,892,148.
Figure 14:
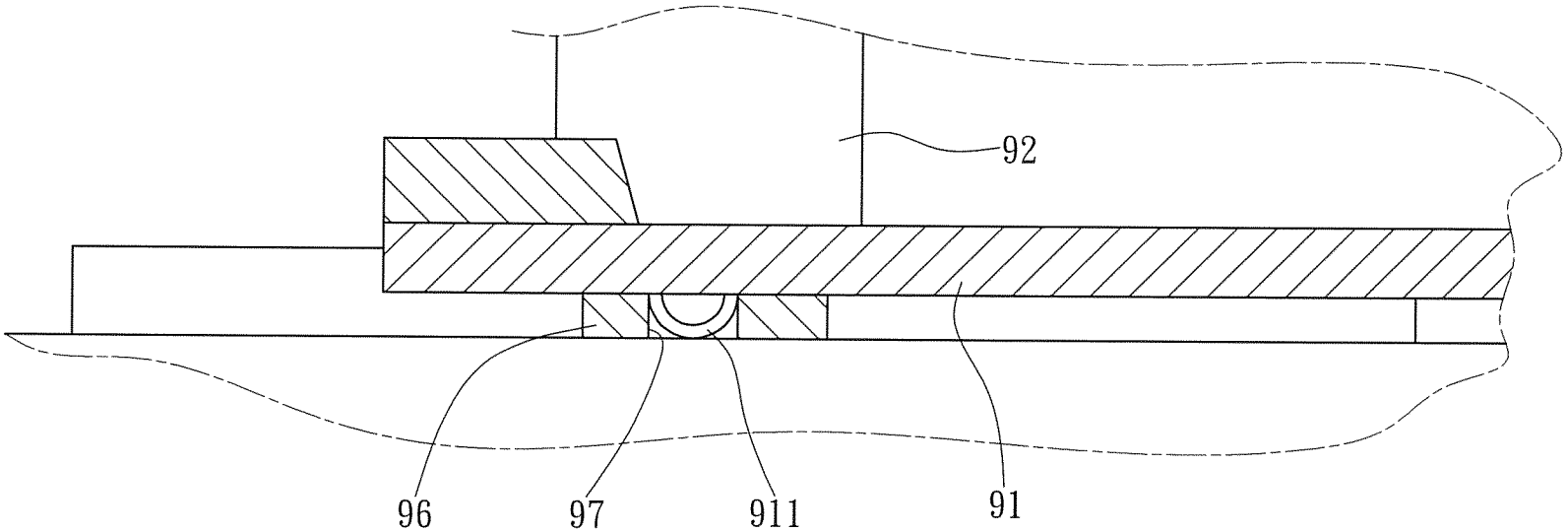
FIG. 14 PRIOR ART
FIG. 14 illustrates a schematic assembled view of the exercise device disclosed in U.S. Pat. No. 7,892,148.

It is understood that, as shown in FIGS. 11 to 12, an office walking equipment according to a third embodiment of the present invention is illustrated. In this embodiment, the structure of the first baffle member 41 and that of the second baffle member 43 are exchanged. In other words, when the platform is at the first position S1, one side of the second baffle member 43 near to the first baffle member 41 has a baffle section 44 in downward arc shape, and the first baffle member 41 has a protruded bar 411. When the platform 21 is at the first position S1, the protruded bar 411 of the first baffle member 41 is restricted within the baffle section 44 of the second baffle member 43. Accordingly, with the first baffle member 41 and the second baffle member 43, the working table 11 and the platform 21 can be assembled with each other to form the equipment rapidly and conveniently, the displacement of the working table 11 can be restricted, and the working table 11 can be prevented from being toppled over. The third embodiment is a modification of the first embodiment and is within the scope of the present invention.

While the means of specific embodiments in present invention has been described by reference drawings, numerous modifications and variations could be made thereto by those skilled in the art without departing from the scope and spirit of the invention set forth in the claims, such as exchanging the position between the first baffle member and the second baffle member. The modifications and variations should in a range limited by the specification of the present invention.

What is claimed is:

1. An office walking equipment, comprising:

a platform disposed on the ground and capable of allowing a user to perform walking exercise;

a working table principally provided for work, wherein the platform has a front end, wherein when the platform is in use, the front end is relatively positioned below the working table, so that the platform is at a first position that allows the user to perform walking exercise thereon, wherein when the platform is separated from the working table, the platform is at a second position, and wherein the platform has a supporting structure provided for resting the platform on the ground; and a limiting device having a first baffle member disposed on the platform and a second baffle member disposed on the working table, wherein when the platform is at the first position, the position of the first baffle member corresponds to the position of the second baffle member, and a gap is defined between the first baffle member and the second baffle member, so that the first baffle member is not in contact with the second baffle member, and a force applied to the platform is not transmitted to the working table to prevent the working table from being shaken, and wherein when the working table is moved with respect to the platform, the first baffle member restricts a displacement of the second baffle member so as to prevent the working table from being toppled over.

2. The office walking equipment of claim 1, wherein the supporting structure comprises a base, and pivot portions which are respectively assembled to the platform and the base, such that after the platform is separated from the working table, the platform is pivotable with respect to the base so as to be stood on the ground.

3. The office walking equipment of claim 2, wherein a fastening element is disposed between the base and the platform to hold the platform standing on the ground.

4. The office walking equipment of claim 1, wherein the first baffle member is disposed across and above the second baffle member, and wherein when the platform is lifted to a predetermined height, the first baffle member uncovers the second baffle member, and the platform is separable with respect to the working table.

5. The office walking equipment of claim 1, wherein the first baffle member and the second baffle member of the limiting device are respectively extended and protruded from side portions of the platform and side portions of the working table.

6. The office walking equipment of claim 1, wherein one side of the first baffle member near to the second baffle member has a baffle section in an upward arc shape, the second baffle member has a protruded bar, and wherein when the platform is at the first position, the protruded bar of the second baffle member is restricted within the baffle section of the first baffle member.

7. The office walking equipment of claim 1, wherein one side of the second baffle member near to the first baffle member has a baffle section in downward arc shape, the first baffle member has a protruded bar, wherein when the platform is at the first position, the protruded bar of the first baffle member is restricted within the baffle section of the second baffle member.

8. The office walking equipment of claim 1, wherein the supporting structure is disposed at the front end of the platform, and the supporting structure defines a supporting plane at the front end of the platform to abut against the ground.

* * * * *